US006578769B1

(12) United States Patent
Mathew et al.

(10) Patent No.: US 6,578,769 B1
(45) Date of Patent: Jun. 17, 2003

(54) THERMOSTAT HOUSING

(75) Inventors: Boney A. Mathew, Clarkston, MI (US); Carl S. Howarth, Bloomfield Hills, MI (US)

(73) Assignee: Mathson Intellectual Technology Inc., Troy, MI (US)

( * ) Notice: Subject to any disclaimer, the term of this patent is extended or adjusted under 35 U.S.C. 154(b) by 0 days.

(21) Appl. No.: 10/171,216

(22) Filed: Jun. 12, 2002

(51) Int. Cl.[7] ..... F01P 7/16
(52) U.S. Cl. ..... 236/34; 236/100
(58) Field of Search ..... 236/34, 34.5, 93 R, 236/93 A, 99 J, 99 K, 100

(56) References Cited

U.S. PATENT DOCUMENTS 4,196,847 A * 4/1980 Gobien ..... 236/34.5
4,280,655 A * 7/1981 Duprez et al. ..... 236/34.5
4,456,167 A * 6/1984 Buter ..... 236/34.5
4,961,530 A * 10/1990 Wagner ..... 236/34.5
4,979,671 A * 12/1990 Bigcharles ..... 236/34.5
5,163,613 A * 11/1992 Ragan ..... 236/34.5
5,607,104 A * 3/1997 Naclerio et al. ..... 236/34.5
5,669,363 A * 9/1997 Francis ..... 123/563

* cited by examiner

*Primary Examiner*—William E. Tapolcai
(74) *Attorney, Agent, or Firm*—Howard & Howard

(57) ABSTRACT

A thermostat housing assembly (10) presents a mounting face (22) including n outer seal (26) disposed in an outer seal groove (24) and an inner seal (32) disposed in an inner seal groove (30). The outer seal (26) includes a lip (38) extending radially inwardly to a distal end cantilevered over the annular wall for retaining the flow control valve (14) in the recess (28). A channel (42) extends radially between the seal grooves (24) and (30) for receiving each of a plurality of spokes (40). A shoulder (46) on each of the spokes (40) snaps over an undercut (44) in each of the channels (42).

13 Claims, 3 Drawing Sheets

THERMOSTAT HOUSING

BACKGROUND OF THE INVENTION

1. Field of the Invention

The subject invention relates to a thermostat housing assembly for mounting on an engine to control coolant flow.

2. Description of the Prior Art

A conventional thermostat for an engine includes a valve biased to a closed position by a spring and includes an expandable system that expands in response to heat to open the valve against the spring. The thermostat includes a metal carrier that is disposed in the housing before the housing is mounted into sealed relationship with the engine. The thermostat is often placed in the housing before the housing is mounted on the engine. It is often a problem to obtain adequate sealing and to retain the thermostat valve and/or the seals in position during shipment and handling of the assembly before mounting on the support structure of an engine.

SUMMARY OF THE INVENTION

A thermostat housing assembly comprises a housing having a flange for mounting the housing on a support structure and a tubular spout extending from the flange and defining a passageway extending from an opening in the spout to an opening in the flange for fluid to flow therethrough. The flange presents a mounting face for engaging the support structure and an outer seal groove therein and an outer seal is disposed in the outer seal groove for sealing the flange to the support structure. The flange has a recess therein disposed radially inwardly of the outer seal groove and has an annular wall extending downwardly to a bottom surrounding the passageway. The assembly is characterized by the bottom having an inner seal groove disposed therein and an inner seal disposed in the inner seal groove for sealing engagement with the flow control valve.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
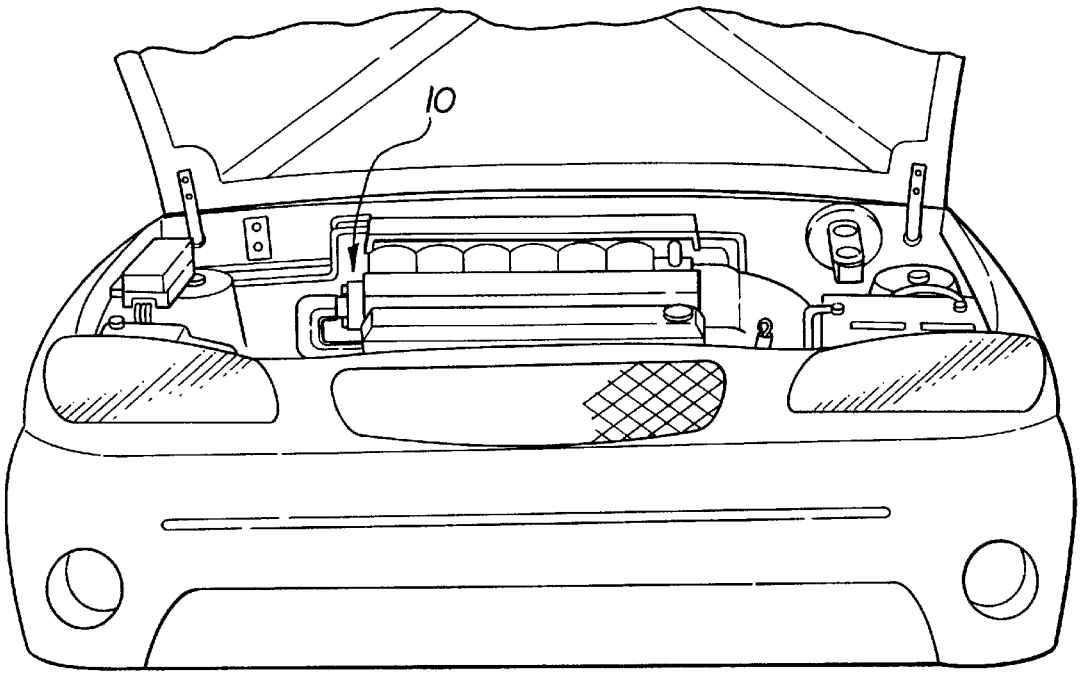
FIG. 1 is a perspective view showing an automotive engine to which the subject invention is mounted.
Figure 2:
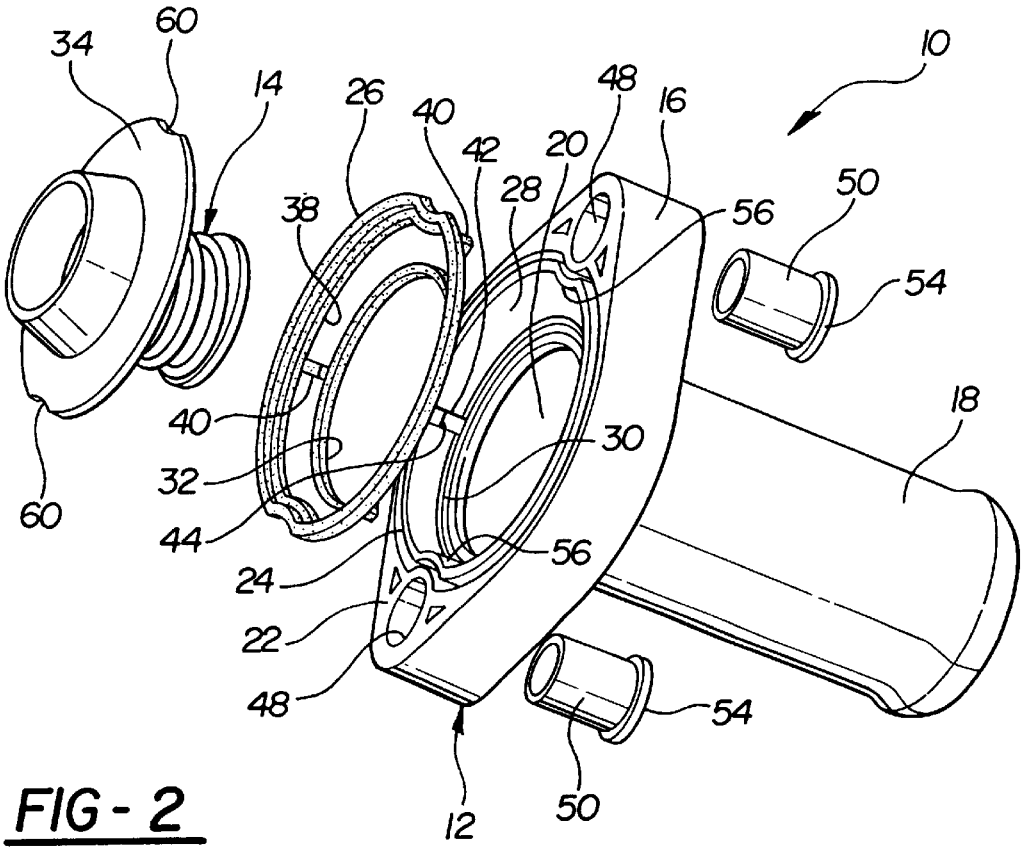
FIG. 2 is an exploded perspective view showing the subject invention.
Figure 3:
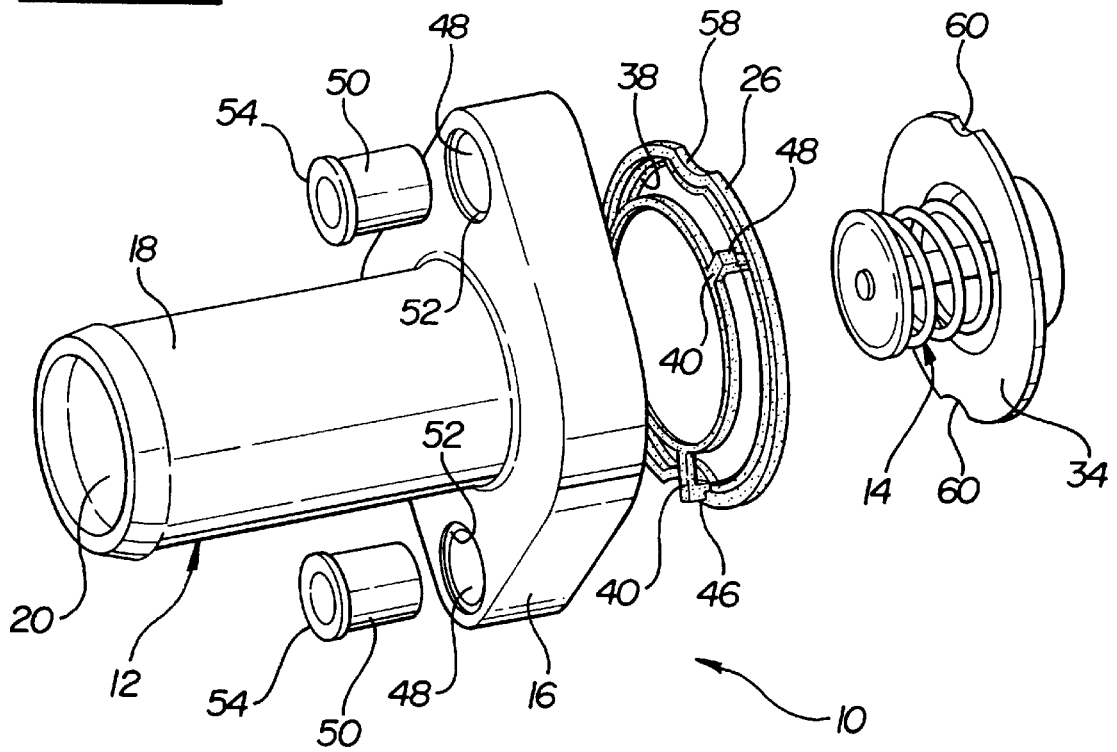
FIG. 3 is an exploded perspective view from the opposite direction than FIG. 2.
Figure 4:
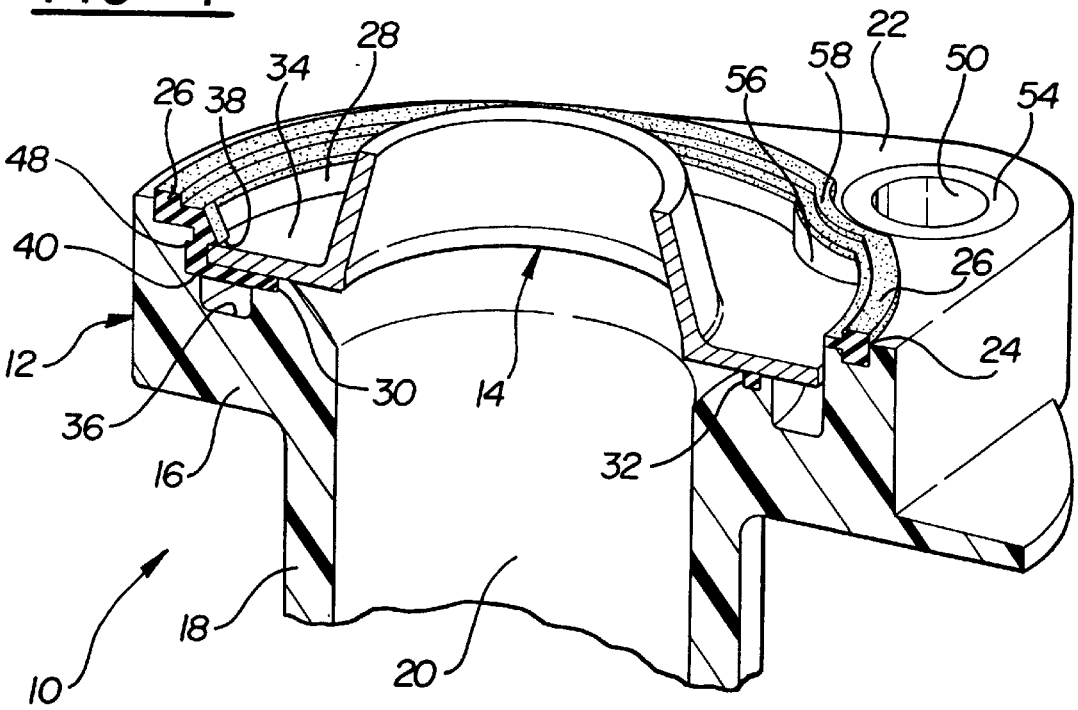
FIG. 4 is an enlarged perspective view partially cut away and in cross section.
Figure 5:
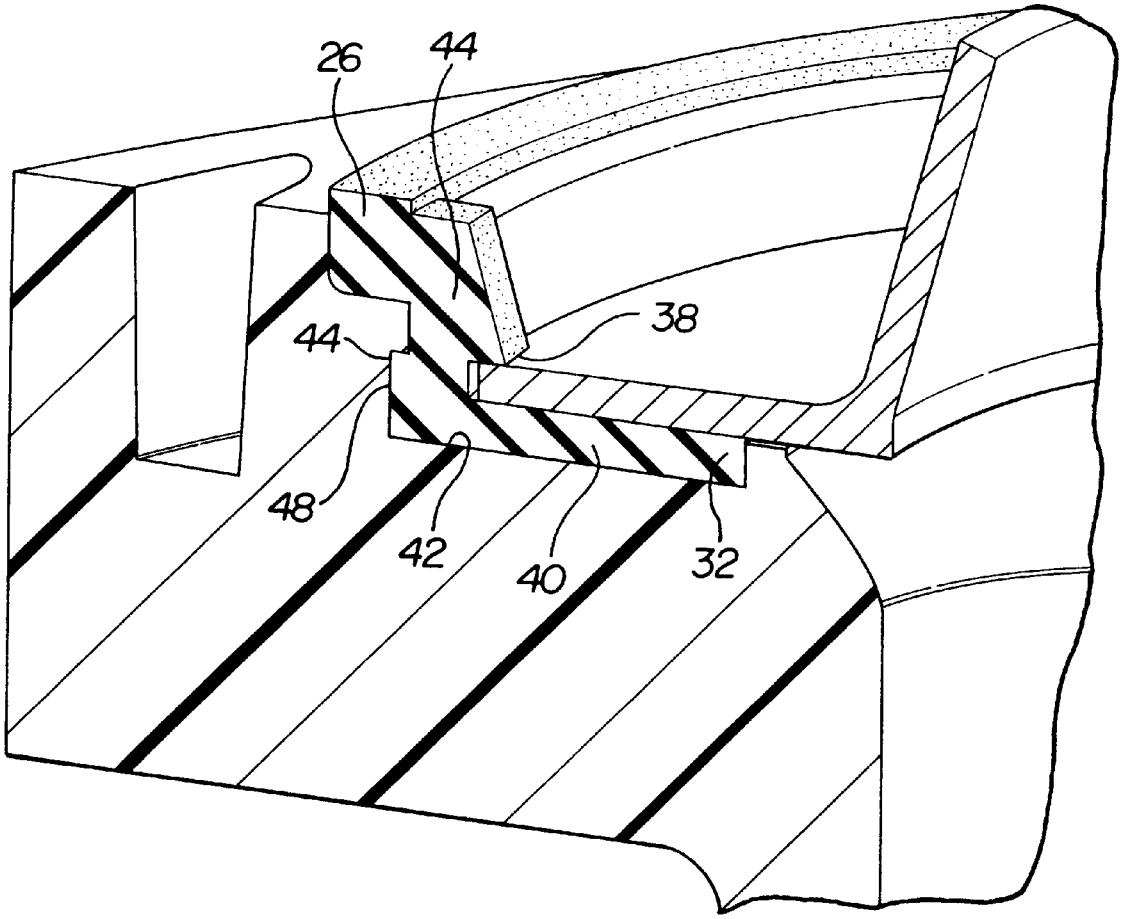
FIG. 5 is an enlarged perspective view partially cutaway and in cross-section of the left hand portion of FIG. 4.

Referring to the Figures, wherein like numerals indicate like or corresponding parts throughout the several views, a thermostat housing assembly is generally shown at 10. The assembly 10 includes a housing, generally indicated at 12, and a thermostat or flow control valve, generally indicated at 14.

The housing 12 has a flange 16 for mounting the housing 12 on a support structure, such as an engine, and a tubular spout 18 extending from the flange 16 and defining a passageway 20 extending from an opening in the spout 18 to an opening in the flange 16 for fluid to flow therethrough. The flange 16 presents a mounting face 22 for engaging the support structure and includes an outer seal groove 24 therein. An outer seal 26 is disposed in the outer seal groove 24 for sealing the flange 16 to the support structure, e.g., engine.

The flange 16 also has a recess 28 therein disposed radially inwardly of the outer seal groove 24 and having an annular wall extending downwardly to a bottom surrounding the passageway 20. The bottom has an inner seal groove 30 disposed therein and an inner seal 32 is disposed in the inner seal groove 30 for sealing engagement with the flow control valve 14. More specifically, the flow control valve 14 is operable in response to temperature of a fluid to open and close to permit or prohibit flow of the fluid through the 20 passage in the housing 12 and the valve 14 has a radially extending rim 34 disposed in the recess 28 and overlying and resting upon the inner seal 32. The bottom of the recess 28 is relieved at 36 in order to conserve material and weight. Operating pressure holds the rim 34 of the valve 14 in contact with the inner seal 32.

In order to retain the inner 32 and outer 26 seals during shipment and handling, a retention device is included for retaining at least one of the seals 26 and 32 in its respective groove 24 and 30. A plurality (three) spokes 40 interconnect the inner 32 and outer 26 seals and the retention device includes a mechanical interlock between each of the spokes 40 and the housing for retaining both of the seals in the respective grooves. More specifically, the housing 12 includes a channel 42 extending radially between the seal grooves 24 and 30 for receiving each of the spokes 40 and the mechanical interlock comprises an undercut 44 in each of the channels 42 and a shoulder 46 on each of the spokes 40 for snapping over the undercut 44. Accordingly, as inner 32 and outer 26 seals are disposed in the respective inner 24 and outer 30 grooves, the spokes 40 are disposed in the channels 42 and the shoulders 46 snap over the undercuts 44 thereby retaining the seals 26 and 32 in the grooves and attached to the housing 14.

The outer seal 26 includes a lip 38 extending radially inwardly to a distal end cantilevered over the annular wall for retaining the flow control valve 14 in the recess 28. The lip 38 is flexible to allow the rim 34 to snap past the lip 38 and the lip 38 to snap back and retain the valve 14 to the housing 12 during shipment and handling.

The flange 16 has at least two holes 48 extending therethrough for receiving fasteners, e.g., bolts, (not shown) for mounting the housing 12 on a support structure, such as the engine. A bushing 50 is disposed in each of the holes 48. Each of the holes 48 includes a countersunk portion 52 extending into the mounting face 22 of the flange 16 and each of the bushings 50 includes an head 54 disposed in the countersunk portion 52 of one of the holes 48.

The annular wall of the recess 28 includes a protrusion 56 surrounding each of the holes 48 and extending radially into the recess 28. The outer seal groove 24 follows the protrusion 56 around the holes 48 and the outer seal includes an arcuate section 58 for mating engagement therewith. The rim 34 of the valve 14 includes a cutout 60 receiving each of the protrusions 56.

The thermoplastic housing and seal assembly can be molded using a two shot and/or insert molding and allows a removable thermostat. The housing 12 can consist of structural thermoplastic such as PPA, Nylon, PPS, or PBT. The seals may be of thermoplastic elastomers such as Polypropylene & EPDM based TPE, or fluoropolymers such as THV, FEP, PFA, EFTE, VFEP, etc., or one which is polyester based. One could also use a thermostat elastomer such as silicone.

The invention provides a single seal assembly that seals the housing 12 as well as the thermostat valve rim 34, thereby preventing flow through the spout 18 prior to the opening of the valve 14, and preventing coolant from leaking. The lip 38 also allows the thermostat valve 14 to be removed from the housing 12, and allows replacement of the thermostat valve 14 without replacing the seals 26 and 32.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A thermostat housing (12) assembly comprising;

a housing (12) having a flange (16) for mounting said housing (12) on a support structure and a tubular spout (18) extending from said flange (16) and defining a passageway (20) extending from an opening in said spout (18) to an opening in said flange (16) for fluid to flow therethrough, said flange (16) presenting a mounting face (22) for engaging the support structure and an outer seal groove (24) therein, an outer seal (26) disposed in said outer seal groove (24) for sealing said flange (16) to the support structure, and said flange (16) having a recess (28) therein disposed radially inwardly of said outer seal groove (24) and having an annular wall extending downwardly to a bottom surrounding said passageway (20), said assembly characterized by said bottom having an inner seal groove (30) disposed therein and an inner seal (32) disposed in said inner seal groove (30) for sealing engagement with a flow control valve (14).

2. An assembly as set forth in claim 1 including a retention device for retaining at least one of said seals (26) or (32) in its groove (24) or (30).

3. An assembly as set forth in claim 2 including spokes (40) interconnecting said inner (32) and outer (26) seals.

4. An assembly as set forth in claim 3 wherein said retention device includes a mechanical interlock between at least one of said spokes (40) and said housing (12) for retaining both of said seals (26) and (32) in said respective grooves (24) and (30).

5. An assembly as set forth in claim 1 including a lip (38) extending radially inwardly from at least one of said spokes (40) for retaining the flow control valve (14) in said recess (28).

6. An assembly as set forth in claim 5 wherein said housing (12) includes a channel (42) extending radially between said seal grooves (24) and (30) for receiving each of said spokes (40).

7. An assembly as set forth in claim 6 wherein said mechanical interlock comprises an undercut (44) in each of said channels (42) and a shoulder (46) on each of said spokes (40) for snapping over said undercut (44).

8. An assembly as set forth in claim 2 wherein said flow control valve (14) is operable in response to temperature of a fluid to open and close to permit or prohibit flow of the fluid through said passage in said housing (12), said valve (14) having a radially extending rim (34) disposed in said recess (28) and overlying and resting upon said inner seal (32).

9. An assembly as set forth in claim 2 wherein said flange (16) has at least two holes (48) extending therethrough for receiving fasteners for mounting said housing (12) on a support structure, a bushing (50) disposed in each of said holes (48).

10. An assembly as set forth in claim 9 wherein each of said holes (48) includes a countersunk portion (52) extending into said mounting face (22) of said flange (16) and each of said bushings (50) includes an head (54) disposed in said countersunk portion (52) of one of said holes (48).

11. An assembly as set forth in claim 10 wherein said annular wall of said recess (28) includes a protrusion (56) surrounding each of said holes (48) and extending radially into said recess (28).

12. An assembly as set forth in claim 11 wherein said outer seal groove (24) follows said protrusion (56) around said holes (48).

13. An assembly as set forth in claim 12 including a flow control valve (14) operable in response to temperature of a fluid to open and close to permit or prohibit flow of the fluid through said passage in said housing (12), said valve (14) having a radially extending rim (34) disposed in said recess (28) and overlying and resting upon said inner seal (32), said rim (34) of said valve (14) including a cutout (60) receiving each of said protrusions (56).

* * * * *